United States Patent [19]

Shigenobu et al.

[11] Patent Number: 4,693,587

[45] Date of Patent: Sep. 15, 1987

[54] IMAGE FORMING APPARATUS

[75] Inventors: Michio Shigenobu, Tokyo; Takashi Saito, Ichikawa, both of Japan

[73] Assignee: Canon Kabushiki Kaisha, Tokyo, Japan

[21] Appl. No.: 753,872

[22] Filed: Jul. 11, 1985

[30] Foreign Application Priority Data

Jul. 16, 1984 [JP] Japan ..... 59/147099
Oct. 22, 1984 [JP] Japan ..... 59/221455

[51] Int. Cl.[4] ..... G03G 15/20; G03G 21/00

[52] U.S. Cl. ..... 355/3 FU; 100/158 R; 162/271; 219/216; 219/469; 355/14 FU; 432/60

[58] Field of Search ..... 355/3 R, 3 FU, 14 FU; 219/216, 469, 470, 471; 432/60; 162/271; 29/122; 100/155 R, 158 R, 176

[56] References Cited

U.S. PATENT DOCUMENTS

| | | | |
|---|---|---|---|
| 1,054,721 | 3/1913 | Simon | 29/122 X |
| 2,729,581 | 1/1956 | Pascoe et al. | 100/176 X |
| 3,884,623 | 5/1975 | Slack | 219/469 X |
| 3,999,038 | 12/1976 | Sikes et al. | 219/216 X |
| 4,378,152 | 3/1983 | Edwards et al. | 355/3 FU |
| 4,419,003 | 12/1983 | Fujie et al. | 355/3 FU |
| 4,475,896 | 10/1984 | Bains | 162/271 X |

FOREIGN PATENT DOCUMENTS

| | | | |
|---|---|---|---|
| 56-52782 | 5/1981 | Japan | 355/3 FU |
| 58-184173 | 10/1983 | Japan | 355/3 FU |
| 58-172672 | 10/1983 | Japan | 355/3 FU |

*Primary Examiner*—Fred L. Braun
*Attorney, Agent, or Firm*—Fitzpatrick, Cella, Harper & Scinto

[57] ABSTRACT

An image forming apparatus wherein an unfixed image is formed on a recording material at an unfixed image forming station, such as an image transfer station or a station for developing an electrostatic latent image. The unfixed image is fixed by a fixing device including a couple of fixing rollers, one of which is substantially frustoconical. The present invention is effective to avoid the possible disturbance to the image caused by the frustoconical shape of the roller. The preferable arrangement is such that the distance between the image forming station and the nip formed between the rollers is shorter than the length of the recording material, and that the nip is non-parallel with respect to the leading edge of the on-coming recording material. Further, the small diameter side of the conical roller receives the leading edge of the sheet earlier than the large diameter side of the frustoconical roller.

23 Claims, 13 Drawing Figures

IMAGE FORMING APPARATUS

FIELD OF THE INVENTION AND RELATED ART

The present invention relates to an image forming apparatus provided with a couple of image fixing rollers, such as a printer and copying apparatus.

A roller type image fixing device has been put into practice wherein an unfixed image is fixed on a recording material such as a sheet or paper by pressure or by combination of pressure and heat.

In the device of a pressure fixing type, the sheet is passed through a nip formed between the rollers, while applying a high pressure to the sheet and to the unfixed toner image. This system is disclosed, for example, in U.S. Pat. Nos. 4,235,166, 4,192,229 and 4,022,122, wherein the couple of rollers are skewed so as to provide a uniform pressure. When, however, the entire leading edge of the sheet enters the nip between the rollers all at once, the driving source for the rollers receives abruptly a heavy load. In order to avoid this, a proposal has been made wherein the leading edge gradually entires the nip, as shown in FIG. 1 which will be explained hereinafter. Japanese Laid-Open Utility Model Application No. 40248/1978 discloses this arrangement. In such a structure, leading edge of the sheet as a recording material can enter the nip inclinedly so that the shock can be reduced. However, there is a problem that the trailing portion of the sheet or recording material is deviated in the lateral direction because the sheet transporting condition suddenly changes.

The inventors of the present application have found that this problem results in the deviation of the image formed in the trailing portion of the sheet, when the distance between the image transfer station and the nip between the rollers is shorter than the length of the recording sheet. Since it is a recent trend that the size of electrophotographic machines or the like is reduced, the above-mentioned distance becomes shorter, so that this problem is significant. The inventors have investigated the problem in the case of an electrophotographic copying apparatus of an image transfer type, and the problem has been analyzed as follows.

FIG. 1 is a top plan view of the image transfer station and the image fixing station. In this image transfer station, a developed image is transferred onto a sheet of paper P from a photosensitive drum 5. In the fixing station, there are rollers 1 and 2 forming a nip N therebetween which is inclined with respect to a line M (hereinafter will be called "image transfer line" or "transfer line") by an angle $\theta$, the image transfer line being a line passing through the center of the image transfer position and perpendicular to the direction of the recording sheet movement and the extension of the line. Therefore, the line of the nip N crosses the image transfer line M at a point O. The sheet P shown by solid lines is passing through the couple of rollers 1 and 2, while the sheet P depicted by broken lines is approaching the nip N. Indicated by reference Po is the leading edge of the sheet P of paper.

In order to investigate the image transfer action in this arrangement, an image to be transferred from the photosensitive drum 5 to the sheet P at a point Q on the photosensitive drum 5 is taken. That is, the image to be transferred as a line extending in the direction of the sheet movement, is considered.

The sheet P moves without influence of the couple of rollers 1 and 2, before the leading edge Po thereof is gripped in the nip N. Therefore, the sheet P travels in the direction perpendicular to the transfer line M (in the direction Ao) so that the image transferred onto the sheet P is a straight line L perpendicular to the image transfer line M as shown by broken lines.

With time, the leading edge Po reaches the nip N between the couple of rollers 1 and 2, and at this time, the image is transferred at a point B. After the nip N takes the sheet P, the sheet is drawn by the rollers 1 and 2, so that the direction of the sheet movement becomes perpendicular to the nip line N (the direction indicated by an arrow A), that is, the sheet P is conveyed inclinedly, since the nip is nonparallel to a line perpendicular to the movement of the sheet given through the image transfer station. Because of this, the image transferred at the point Q after the point B is inclined as shown by the line BQ which is inclined. At the trailing edge of the sheet, the transferred image is at a point C which is the intersecting point between the trailing edge of the sheet P and the extension of the line BQ.

In this manner, the image which is to be formed as a straight line L and the extension thereof, is formed as a non-straight line as shown in FIG. 2, wherein the trailing portion of the image is inclined as the line BQ. The deviation or offset at the trailing edge is the distance between the point C and a point H which is the intersecting point between the trailing edge of the sheet P and the extension of the line L. The angle formed between the extension of the line L and the line BQ is equal to the angle $\theta$ formed between the transfer line M and the nip line N.

The above-described analysis applies to the case of a couple of rollers with a skew angle in which case the nip line N of the skewed roller couple is made to correspond to the nip line N of the abovemade described arrangement.

The inventors have found, as described above, that when the sheet is introduced to the nip with an angle $\theta$ ($0<\theta<90°$) formed between the nip line and the leading edge Po, the image is transferred with deviation. The present invention is intended to provide a solution to the problem recognized by the inventors.

SUMMARY OF THE INVENTION

Accordingly, it is a principal object of the present invention to provide an image forming apparatus wherein the deviation of the image transfer adjacent to the trailing edge of the recording sheet is prevented.

It is another object of the present invention to provide an image forming apparatus wherein the position such as an image transfer position or an image developing position where an unfixed image is formed on the recording paper, is distant from an image fixing station where the unfixed image is fixed by a couple of fixing rollers, by the distance smaller than the length of the recording paper, and wherein the possible disturbance to the image adjacent to the trailing edge of the recording sheet is prevented.

It is a further object of the present invention to provide an image forming apparatus wherein inconveniences which may be caused by a curling of a recording material formed between an image forming position and an image fixing position is removed.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 3:
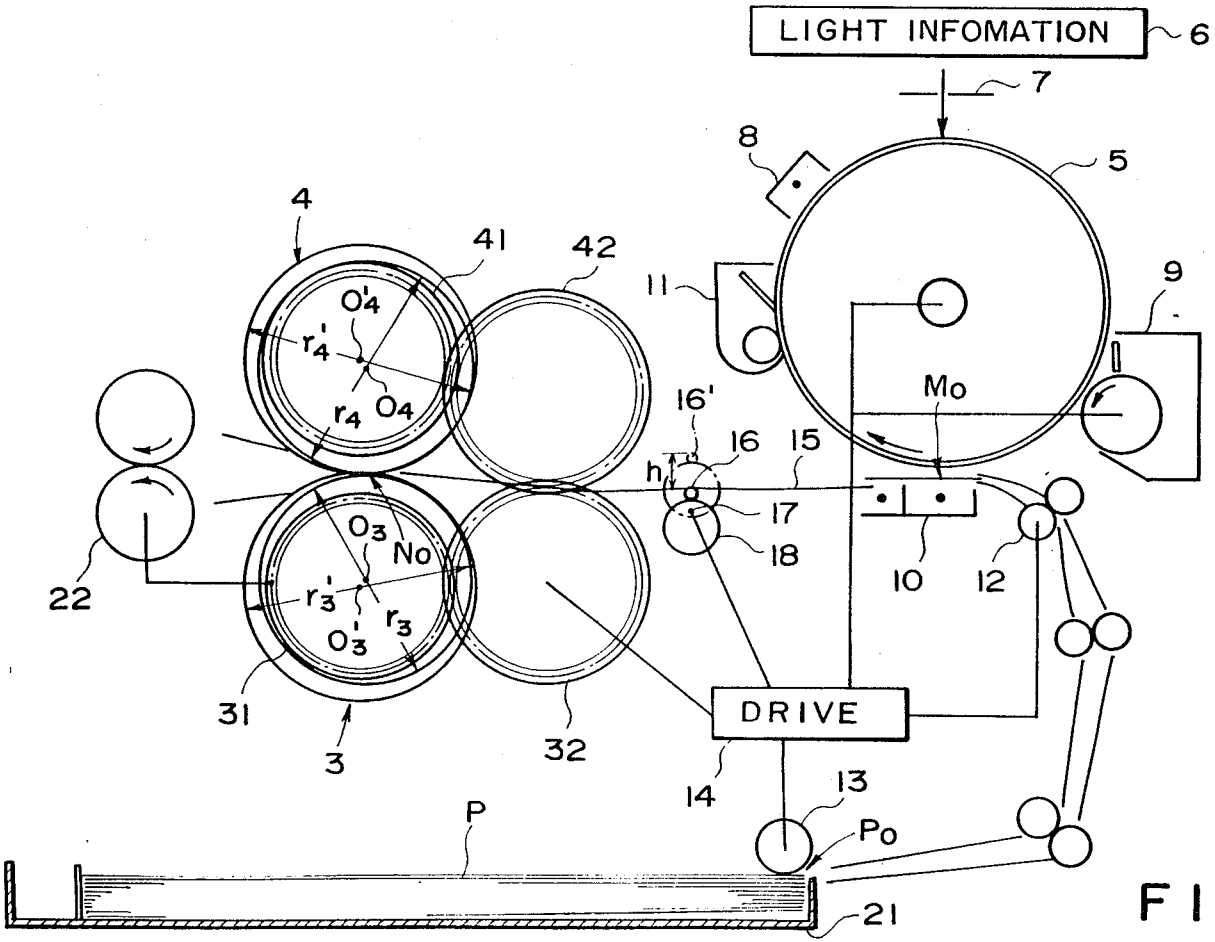
FIG. 3 is a front view of an image forming apparatus according to an embodiment of the present invention.

Referring to FIG. 3, there is shown an electrophotographic apparatus according to an embodiment of the present invention wherein a photosensitive drum 5 serving as an image bearing member is provided with a photosensitive layer of amorphous silicon. Around the photosensitive drum 5, a charger 8, a slit 7 (an image exposure station), a developing device 9, an image transferring device 10 (an image transfer station Mo) for forming an unfixed toner image on a recording material in the form of a sheet of paper and a cleaning device 11 for removing residual toner from the photosensitive drum 5, which elemens are known. Designated by a reference 6 is an image exposure device comprising a lens, a mirror and a lamp as in usual copying apparatus or a light information forming device for forming a beam imagewisely modulated as in a laser beam optical device.

The sheets P of paper are accommodated in a cassette 21 and are taken out thereof one by one by a pick-up roller 13 in response to image formation start. A registration rollers 12 stop the sheet P at the leading edge thereof and re-feed the sheet P at such a timing that the sheet P is in alignment with the image formed on the photosensitive drum. A guiding plate 15 is effective to guide the sheet P to the nip No formed between the rollers 3 and 4, and is inclined to form a slightly recessed portion. The sheet P is kept closely contacted to the guiding plate 15 until a part of the sheet is gripped in the nip No. The guiding plate 15 may be replaced with a rotatable member such as a rotatable conveyer belt, in which case the sheet P is carried on the rotatable member. In any event, the substantial distance of the conveying passage for the sheet P is determined on the basis of the surface thereof.

Figure 4:
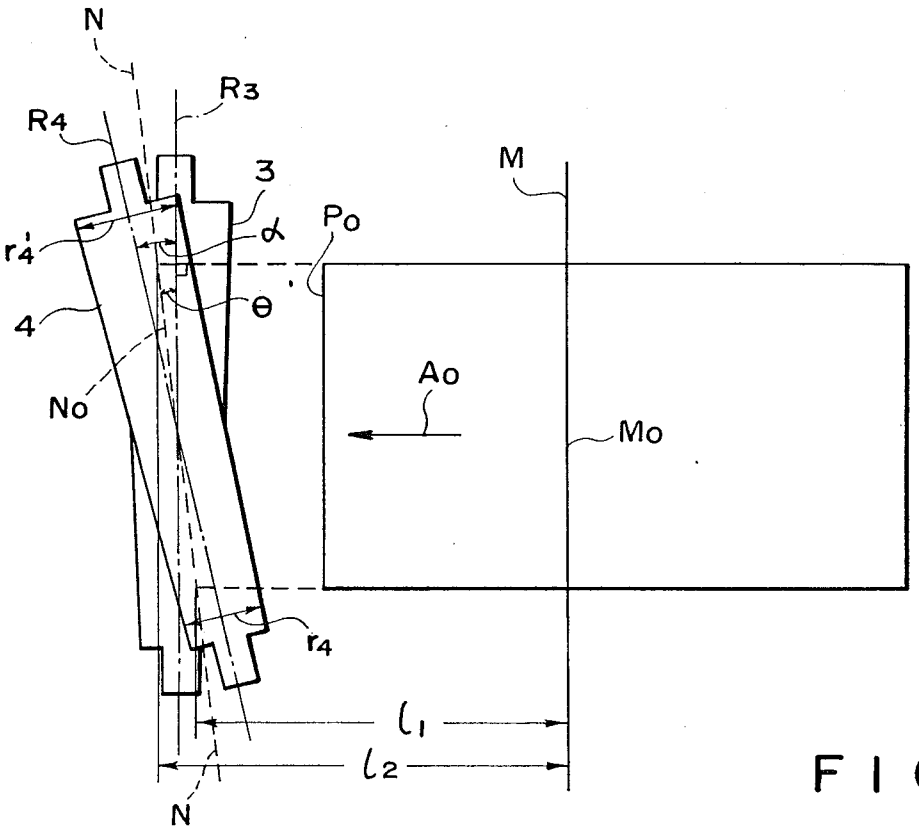
FIG. 4 is a plan view illustrating the relation between rollers 3 and 4 and a recording sheet in the arrangement shown in FIG. 3.

The nip No formed between the rollers 3 and 4 as shown in FIG. 3 extends fairly perpendicularly to the sheet of the drawing of this Figure, but as shown in FIG. 4, the nip No is more distant from the transfer station Mo toward the face of FIG. 3 ($l_1 < l_2$). The rollers 3 and 4 will be described in more detail hereinafter in conjunction with FIG. 4. The rollers 3 and 4 each have a relatively smaller diameter (r3 and r4) at one longitudinal end near the front side and a relatively larger diameter (r3' and r4') at the rear side end. The centers thereof are indicated by points O3, O'3, O4 and O'4. The rollers 3 and 4 are provided with gears 31 and 41 which are driven by gears 32 and 42, respectively so that the rotational speeds of the rollers are the same. Driving means 14 is effective to provide rotational driving forces to the gears 32 and 42, a discharging roller 22, a cam 18 which will be described hereinafter, the photosensitive drum, the couple of registration rollers 12 and pick-up roller 13.

Figure 7:
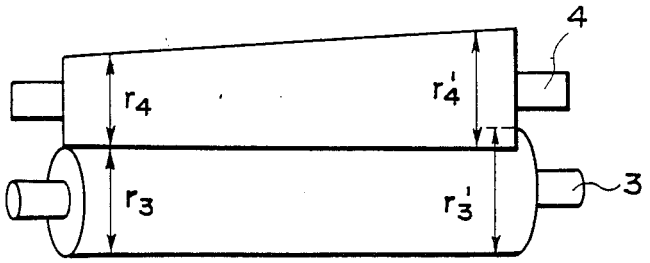
FIG. 7 is a perspective view of rollers 3 and 4 of the fixing device shown in FIG. 4.

The roller 3, as shown in FIGS. 4 and 7, has different diameters r3, r3' at the opposite longitudinal ends, wherein the diameter r3 is smaller than the diameter r3'. Similarly, the roller 4 has the different diameters r4 and r4' at the opposite ends wherein the diameter r4 is smaller than the diameter r4'. The rollers 3 and 4 are so contacted that the smaller diameter portions are contacted with each other and the larger diameter portions are contacted with each other. The nip No is so arranged that it extends with an angle $\theta$ ($0<\theta<90°$) with respect to the image transfer line Mo and the leading edge Po of the sheet P. In this embodiment, the axis R3 of the roller 3 is parallel to the transfer line Mo, that is, it is parallel with the rotational axis of the photosensitive drum 5. Therefore, the smaller diameter ends of the rollers 3 and 4 constitute a part of the nip No which is closest to the transfer line Mo. Therefore, the smaller diameter ends of the rollers 3 and 4 first grip the leading edge Po of the recording sheet P. The lateral end of the sheet P nearer to the smaller diameter ends of the rollers 3 and 4 travels through a distance $l_1$, and the opposite lateral end of the sheet P travels through a distance $l_2$ which is larger than the distance L1, from the transfer line Mo to the nip line No. The longitudinal section of each of rollers 3 and 4 through the axis R3 or R4 is a symmetrical trapezoid, and therefore the rollers are fructoconical, and the larger diameter portion rotates at a higher peripheral speed than that of the smaller diameter portion. Thus, the larger diameter portion provides a higher conveying force. The axes R3 and R4 are skewed by an angle $\alpha$ which is equal to $2\theta$, so as to provide a uniform pressure distribution in the longitudinal direction in the nip No.

Figure 8:
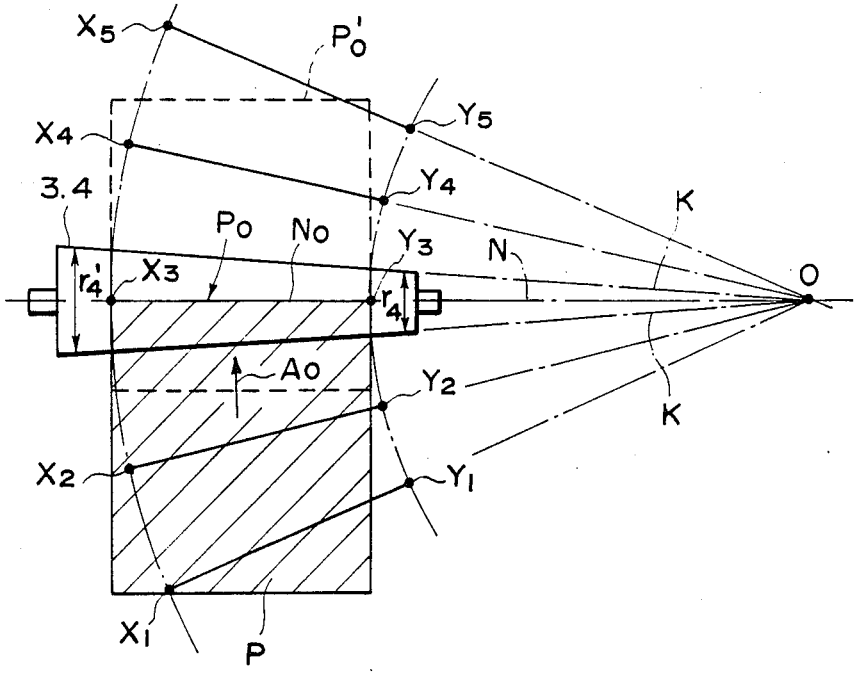
FIG. 8 illustrates movement of the recording sheet by a couple of frustoconical rollers.

Here, the conveyance of the sheet P will be explained when frustoconical rollers are used. FIG. 8 will be used for this explanation, wherein the broken line square indicates the sheet position which would be taken by a sheet if it were conveyed by a couple of straight rollers. For the better understanding, the explanation will first be made with respect to the rollers are not skewed. The nip line N extends perpendicularly to the direction of the conveyance of the sheet P. A point O is the intersecting point between the extensions of the roller axes and the extension of the generating line of the frustoconical roller. In order to analyzed the movement of the sheet P when the sheet P is gripped by the nip N, a phantom line X3–Y3 is assumed which is parallel to the leading edge of the sheet P and passing through a given point on the recording sheet P. FIG. 8 shows the state wherein the phantom line X3–Y3 is just in the nip N (right side in the Figure). When a certain period of time elapses from this state, the line X3–Y3 takes the position shown by a line X4–Y4. Although the direction of the drive given to the sheet P is perpendicular to the nip line N at any point on the nip line N, the amount of the drive or the conveyance is larger where the diameter of the roller is larger, owing to the peripheral speed difference. This is because the amount of conveyance is proportional to the distance from the point O. For this reason, the line X4–Y4 is on a line passing through the point O, and the point X4 is on an arc having the center of the point O and a radius of the distance between the point O and the point X3, while the point Y4 is on an arc having the center of the point O and radius of the distance between the point O and the point Y3. Similarly, when a further certain period of time passes, the phantom line reaches the position shown by the line X5–Y5. The points X5 and Y5 are on the respective arcs described above.

On the other hand, at the instance a certain period of time before the phantom line X3–Y4 is just in the nip N, the line X3–Y3 must have taken the position shown by a line X2–Y2. The line X2–Y2 is on a line passing through the point O. As shown, the point X2 and the point Y2 are on the same respective arcs described above. A further period of time before, the line must have taken the position indicated by a line X1–Y1.

Here, the following is added for the purpose of understanding movement of the sheet P. The line X3–Y3, the line X4–Y4 and the line X5–Y5 correspond to the movement of the leading edge of the sheet, but the line X1–Y1 and the line X2–Y2 does not correspond to the movement of the leading edge. This is because the lines X3–Y3, X4–Y4 and X5–Y5 correspond to a portion of the sheet P after it has been taken by the nip N, but the lines X1–Y1 and X2–Y2 correspond to a portion of the sheet which has not yet been taken by the nip N. However, the lines X1–Y1 and X2–Y2 correspond to the movement of the trailing edge of the sheet P after the sheet is gripped by the nip N.

Generally, the sheet P is conveyed in the direction perpendicular to the nip line N after it has been gripped by the nip N. However, as described above, by changing the roller diameters along the longitudinal direction thereof and changing the amount of conveyance therealong, the movement of the sheet can be changed.

Figure 5:
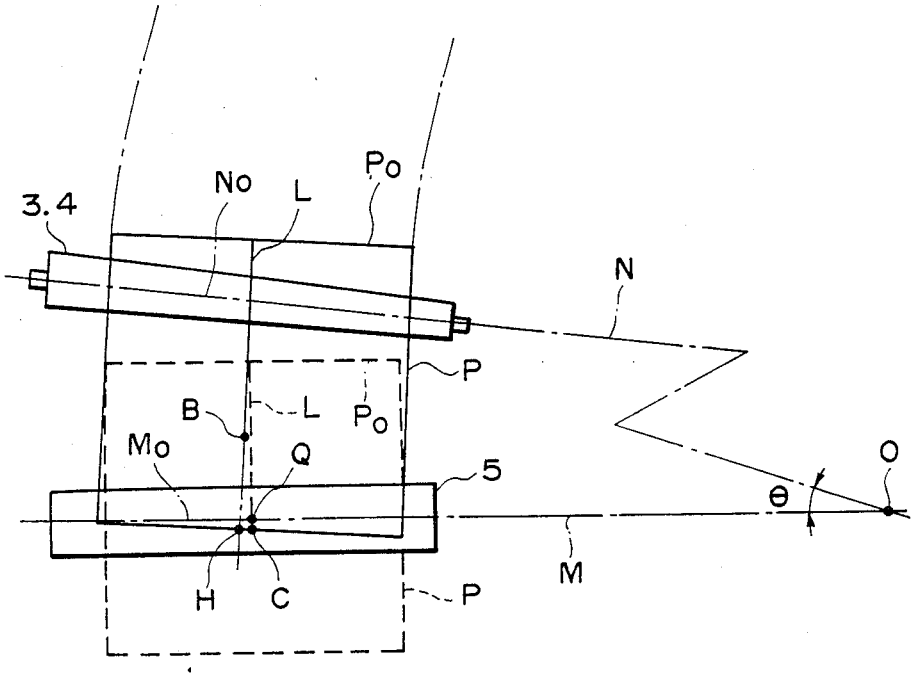
FIG. 5 is a plan view illustrating the effects of the embodiment of the present invention.

Next, the description will be made as to prevention of the image deviation adjacent to the trailing edge of the sheet in conjunction with FIGS. 5 and 6. FIG. 5 shows an arrangement similar to that of FIG. 4, however, the angle $\alpha$ is 0 degrees. The nip line N is inclined with respect to the drum axis by an angle $\theta$. The point O where the nip line N and the extension of the generating line of the roller intersect is on the extension of the image transfer line M. As will be described hereinafter, it is advantageous to place the intersecting point O adjacent to the extension of the image transfer line M.

The sheet P shown by the solid line is indicated in the process of passing through the couple of rollers 3 and 4, while the paper P shown by the broken lines is indicated as approaching the nip N.

In order to consider the image transferred onto the sheet P, an image is supposed which is transferred thereto at a point Q on the photosensitive drum 5, that is, an image which is to be formed on the sheet P as a straight line extending in the direction of the sheet conveyance.

Before the leading edge of the sheet P is gripped by the couple of rollers 3 and 4, the sheet is not influenced by the couple of rollers 3 and 4 so that the sheet P moves perpendicular to the image transfer line M as shown by the broken line, with the result that the image transferred onto the sheet P is a straight line L extending perpendicularly to the image transfer line M.

After the leading edge of the sheet P reaches the nip line N formed between the rollers 3 and 4, it is conveyed in the manner described in conjunction with FIG. 8. Therefore, the image transferred at the point Q constitutes an arc having a radius OQ, as shown by an arc BQ. The point B is the point transferred at the point Q when the leading edge of the sheet P just reaches the nip N. Therefore, the transferred image point at the trailing edge of the sheet P is an intersecting point between the trailing edge and an arcuate extension of the arc BQ.

Figure 2:
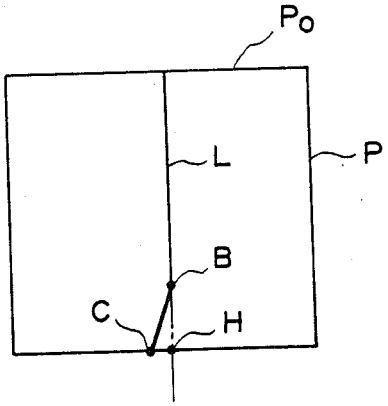
FIG. 2 is a plan view of a recording sheet on which an image to be reproduced as a straight line is reproduced as a non-straight line.
Figure 6:
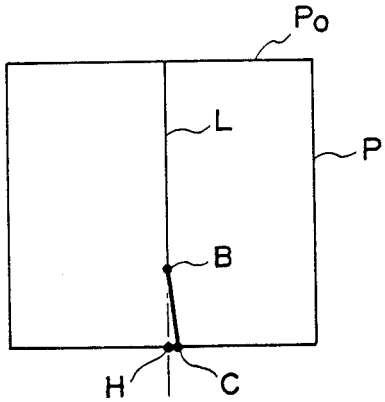
FIG. 6 is a plan view of the recording sheet illustrating the image formed by the arrangement of FIG. 5.

Thus, the image to be formed on the sheet P as the line L and a straight extension thereof is formed in the trailing portion thereof as the arc BC as shown in FIG. 6. The deviation at the trailing edge is the distance between the point C and a point H which is the intersecting point between the extension of the line L and the trailing edge of the sheet P. Comparing FIG. 6 with FIG. 2, the images of the lines adjacent to the trailing edge of the sheet P are different because of the difference of the rollers. The arc BC in FIG. 6 is such that the tangential line thereof at the point B is coincident with the line L since the point O is on the extension of the image transfer line.

The deviation CH is different depending on the radius of the arc and the position of the point O. The radius of the arc is substantially determined by the taper of a usable frustoconical shape of the rollers, and therefore, the amount of deviation is dependent on the position of the point O. However, the above analysis is theoretical, and actually, it can change depending on the state of confinement to the sheet P at the transfer station and the flexibility or resiliency of the sheet P. When the taper of the frustoconical shape is selected to be usually practical in a recording apparatus, more particularly, when the taper is such that the length the line provided by extending the generating line of the frustoconical shape to the point O is 8–25 m, the position of the point O is preferably located adjacent the extension of the image transfer line M, more preferably, the range not more than 40 mm away from the image transfer line M at each side thereof, or within $\frac{1}{4}$ of the distance between the center of the nip line N and the image transfer line M, measured from the image transfer line. This has been empirically confirmed.

Further, in consideration of the fact that the actual image transfer operation is not effected exactly on a line, but is effected in a range having a width (in the direction of the sheet movement), it is further preferable that the point O is positioned within the extension of the width.

As described, the line L is tangential at point B to the arc BC in FIG. 6. This is because the point O is located exactly on the extension of the image transfer line. If the point O is displaced toward the couple of rollers 3 and 4, the tangential line at the point B inclines such that it extends from the left upper to the right bottom, so that the amount of deviation CH increases. On the contrary, if the point O is displaced away from the couple of rollers 3 and 4 beyond the image transfer line M, the tangential line at the point B inclines such that it extends from the right upper to the left bottom, with the result that the amount of deviation CH, and therefore, the average of the deviation in the trailing portion of the sheet decreases. For this reason, it is preferable that the point O is positioned away from the couple of rollers 3 and 4 beyond the extension of the image transfer line M. The foregoing analysis and explanation apply to the couple of rollers 3 and 4 shown in FIG. 4, provided that r3 is equal to r4, and r3′ is equal to r4′ by assuming a phantom frustoconical shape having the same taper as that of the rollers of FIG. 4 and having the generating line coincident with the nip line N (that is, the nip line N of FIG. 4 is the generating line of the phantom frustoconical shape).

In the foregoing examples, each of the rollers 3 and 4 is frustoconical. However, when one of the rollers is a straight roller, that is, a roller having a constant diameter along the longitudinal axis thereof, or when the diameter r3=r3′ and the central portion has a smaller diameter than the end (r3), that is, when the roller surface is concave or spool-shaped or when the shapes of the roller 3 and/or 4 are different, a phantom frustoconical shape is assumed in using the same analysis, the phantom frustoconical shape having a generating line corresponding to the actual nip line and having the same taper as that of the actual frustoconical roller which dominates the transportation of the sheet.

The position of the point O is applicable to the case where the rollers are skewed. And, in the description and statement in this application, the term "frustoconical" or "trapezoid" includes the phantom frustoconical or trapezoid, as far as the present invention is concerned. The phantom "frustoconical" includes the "frustoconical" obtained by determining the diameter at each portion correspondingly to the amount of conveyance at the portion.

The experiments will now be described. In the experiments, rollers having 36 mm diameter of an induction-hardened S45C steel for tools (JIS), the surface of which was treated by hard chrome was used. Referring to FIG. 4, the dimensions of the rollers were, $\alpha=1.8$ degrees; $\theta=0.9$ degree; r3=r4=35.29 mm; r3′=r4′=36 mm; and the length of the roller=270 mm.

In this case, the deviation at the trailing edge of the recording sheet of 257×364 mm was less than 1 mm. The deviation is so significantly reduced that it is 1/10-1/12 of the deviation in the case of a uniform diameter rollers or of the rollers having the same diameters at the opposite ends which do not employ the taper according to the present invention.

Table 1 shows the results of the experiments.

TABLE 1

(unit: mm)

| ROLLER SHAPE | EXAMPLES OF ROLLER ACCORDING TO THE EMBODIMENT | | | | STRAIGHT ROLLER |
|---|---|---|---|---|---|
| IMAGE SAMPLE | 1 | 2 | 3 | AVERAGE | AVERAGE |
| PERPENDICULARITY | 0.2 | 0.2 | 0 | 0.13 | −0.3 |
| LINEARITY A | | | | | |
| A1 | 0.2 | 0.3 | 0.3 | 0.27 | |

TABLE 1-continued (unit: mm)

| ROLLER SHAPE | EXAMPLES OF ROLLER ACCORDING TO THE EMBODIMENT | | | | STRAIGHT ROLLER |
|---|---|---|---|---|---|
| A2 | 0.3 | 0.3 | 0.3 | 0.3 | |
| A3 | 0.3 | 0.4 | 0.3 | 0.33 | |
| LINEARITY B | | | | | |
| B1 e | 0.4 | 0.5 | 0.3 | 0.4 | 0.1 |
| f | 0.2 | 0.2 | 0 | 0.13 | 2.6 |
| B2 e | 0.3 | 0.5 | 0.2 | 0.33 | 0.2 |
| f | 0 | 0.2 | −0.2 | 0 | 2.7 |
| B3 e | 0.3 | 0.5 | 0.2 | 0.33 | 0 |
| f | 0 | 0.2 | −0.1 | 0.03 | 2.5 |

Figure 9:
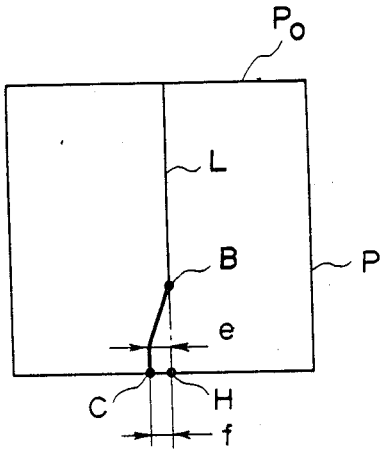
FIG. 9 illustrates in an enlarged scale the results of the experiment with the embodiment of the invention.

In this Table, the image samples 1, 2 and 3 are the images provided by three different points. In the case of straight rollers, the experiments have been carried out with three different points, but the data obtained did not vary, and therefore, the Table shows the results only in the average. The deviations in the Table with "−" sign means the deviation is on the opposite side with respect to the line BH as contrasted to the case of FIGS. 9 and 10.

Figure 10:
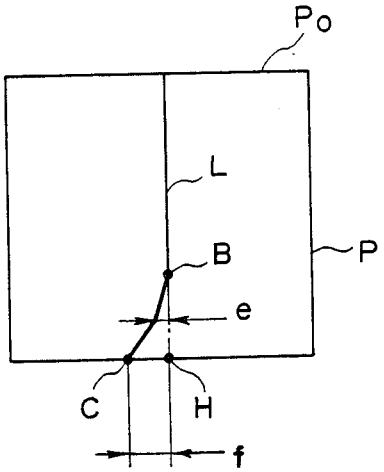
FIG. 10 illustrates in an enlarged scale the results of experiments with a couple of rollers having uniform diameters.

In the Table, the perpendicularity is how much the parallelism at the trailing edge is deviated with respect to a line parallel to the leading edge Po of the sheet. The linearity is the linearity of the line perpendicular to the leading edge Po of the sheet. The Table shows the linearity of A group and B group. The A group indicates the linearity in the full length of the sheet, while the B group is the linearity with respect to the deviation after the sheet has passed through the transfer station on the assumption that it is rectilinear from the sheet passing through the transfer station to the sheet reaching the fixing station. The linearities indicated by "e" and "f" correspond to the structures of FIG. 9 and the straight rollers (FIG. 10). With respect to the latter case, the inclination changes as indicated by the linearity values in "e" and "f", because upon the leading edge of the sheet being gripped by the nip N, the paper is not inclined at once, but is gradually inclined up to the inclination corresponding to the direction perpendicular to the nip line N.

The non-uniformness of the pressure between the rollers may be corrected not only by correcting the bending of the rollers by skewing the roller axis but also by a spool-shape (opposite to crowned shape) of the roller (concave). In the latter case, the sheet conveying performance can be improved, as well as the uniformness of the pressure distribution along the axis. More particularly, the adverse effect by the oblique conveyance of the sheet P is removed by changing the diameters at the opposite ends, that is, employing the generally tapered roller, while the pressure distribution is made uniform along the axis by employing the spool shaped roller so as to reduce the possibility of occurrence of paper wrinkle.

A detailed example of the rollers described in the foregoing paragraph will be explained. The above-described tapered roller was used which had the diameter 35.29 mm at one end and 36.00 mm at the opposite end. The surface of the roller was contoured such that a hyperbola was formed in the manner that at the position 72 mm away from each of the ends, the diameter was 23 microns less than the corresponding end. The pressure of 12 kg/cm on the average was applied. The variation of the pressure distribution was not more than 1.5 kg/cm within 95% of the entire length of the roller. The occurrence of the sheet wrinkle was improved from 0.01% (without the spoolshape) to 0.005%.

The present invention is not limited to a frustoconical roller in the strict sense, but substantially frustoconical rollers are included such as the above-described spool-shaped (reversely crowned) roller, if the diameter of the roller generally increases or decreases from one end to the other. The advantageous effect of the present invention are provided with such structures.

Although the foregoing description has been made with respect to an image fixing device of a pressure fixing type, the present invention is applicable to an image fixing device of a heat fixing type.

Further, as will be understood from the foregoing explanation, the present invention can remove the adverse influence, to the image transfer station, by the couple of rollers downstream of the image transfer station, and therefore, the present invention is not limited to the pressure type fixing device, but it is also applicable to a device for partly fixing the image or to the couple of rollers downstream of the image transfer station, if the partial fixing device or the rollers are effective to apply a conveying force to the sheet.

As described in the foregoing, the deviation of the image on the recording sheet can be reduced by changing the diameter at the opposite ends of the roller to provide the peripheral speed difference, preferably by locating the intersecting point between the generating line of the roller and the nip line between the rollers adjacent the extension of the image forming station such as the image transfer station.

Figure 11:
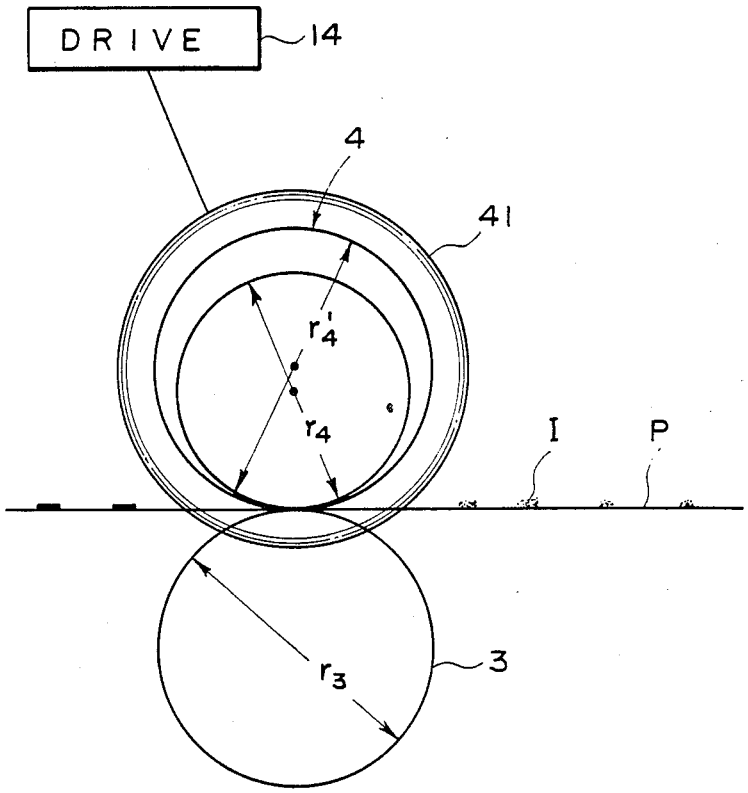
FIG. 11 illustrates the major part of the fixing device used with the image forming apparatus according to the embodiment of the present invention.

FIG. 11 shows another embodiment of the present invention wherein one of the rollers is a frustoconical roller and the other is a symmetrical roller with respect to the center of the length of the roller such as a cylindrical roller or an spool-shaped roller having a small diameter in the middle as compared with the opposite ends. The nip line is inclined with respect to the image transfer line, similar to the foregoing embodiment. The diameter of the frustoconical roller is smaller at the end where the distance between the nip line and the image forming station is small, and the diameter at the opposite end is relatively larger. By this arrangement, the above-described advantageous effect are provided owing to the similar positional relation between the image forming station and the nip, if one of the rollers is frustoconical. In this case, the conveyance of the sheet P by the couple of rollers 3 and 4 is mainly dominated by the frustoconical shape of the roller, and the distribution of the conveying speed by the nip is so determined that it is lower at the side where the leading edge of the sheet reaches earlier, and it is relatively higher at the opposite side.

The experiments by the inventors have indicated that it is more preferable to contact the toner image bearing side of the sheet P to the frustoconical roller 4 than to contact the backside of the sheet P to the frustoconical roller 4 in order to obtain the ensured conveying force. Further, it is further preferable to drive the frustoconical roller 4 by a driving source. In FIG. 11, the frustoconical roller 4 is adapted to contact the toner image (I) bearing side of the sheet P and is provided with a gear 41 which is driven by driving means 14. This is because the frictional coefficient is larger between the roller 4 surface and the toner image bearing surface than between the same roller surface and the backside of the sheet.

When only one of the rollers is frustoconical, the conveying force by the upper roller is different from that of the lower roller, with the result of a shearing force applied to the toner which increases the image fixing action. And, the amount of curling formed between the transfer station and the nip is smaller than when both of the upper and lower rollers are frustoconical, so that the size of the device is reduced. Further, the cost required for manufacturing the entire roller assembly is also reduced.

When at least one of the rollers is frustoconical, the conveying forces are different at the opposite ends of the nip formed between the rollers. Since the driving force applied to the sheet P by the photosensitive drum 5 or the conveying force applied by a conveying mechanism for conveying the sheet P to the photosensitive drum 5, is symmetrical, that is, uniform along the nip, the above-described difference in the conveying force at the nip results in a partial curl. Therefore, the part of the sheet near to the small diameter side of the frustoconical roller is lifted away from the surface of the guide 15. This is hardly a problem when the amount of the curl U is not large, when the conveying force of the rollers 3 and 4 is large enough or when the sheet used is so thin that the rigidity of the paper (the restoring tendency) is insignificant.

It has been found by the inventors that when a relatively thick sheet (so thick that the sheet is lifted by curling more than 20 mm), the restoring force of the sheet degrades the effect of the frustoconical roller. In order to solve this problem, the difference in the outer diameter between the opposite ends of the roller may be increased. However, the increase would lead to the increase of the manufacturing cost.

The inventors further investigated and solved this problem. Because of the above-described rigidity and therefore the restoring force of the sheet P, the occurred curl tends to disappear, that is, to straighten out, which is toward the nip at the nip inlet and toward the transfer station at the transfer station outlet. When the force of contact of the sheet P to the photosensitive drum 5 at the transfer station is relatively weak, and if the restoring force to move the sheet back is larger than the conveying force by the transfer station toward the rollers, the transferred image is deviated due to the curl.

With the view to avoiding this, means is provided to alter the sheet guiding path in accordance with the partial curling of the sheet, more particularly, the guide is partially moved up and down to remove the restoring force of the curl. When a sheet of 64 g/m$^2$ having the length of 364 mm and having a relatively low rigidity was passed from the transfer station to the fixing station having the couple of rollers which stations were distant 137 mm from each other, the amount of the difference in the travel of conveyance between the opposite lateral ends of the sheet was 4.2 mm until the trailing edge of the sheet passed through the transfer station. That is, the lateral end of the sheet near to the small diameter side of the roller moved 4.2 mm less than the opposite lateral side of the sheet, which produced a curl in the less moved side, and the height of the curl U was approximately 24 mm adjacent to the middle between the transfer station and the couple of rollers 3 and 4, when the curled sheet was completely lifted from the guiding surface.

Figure 12:
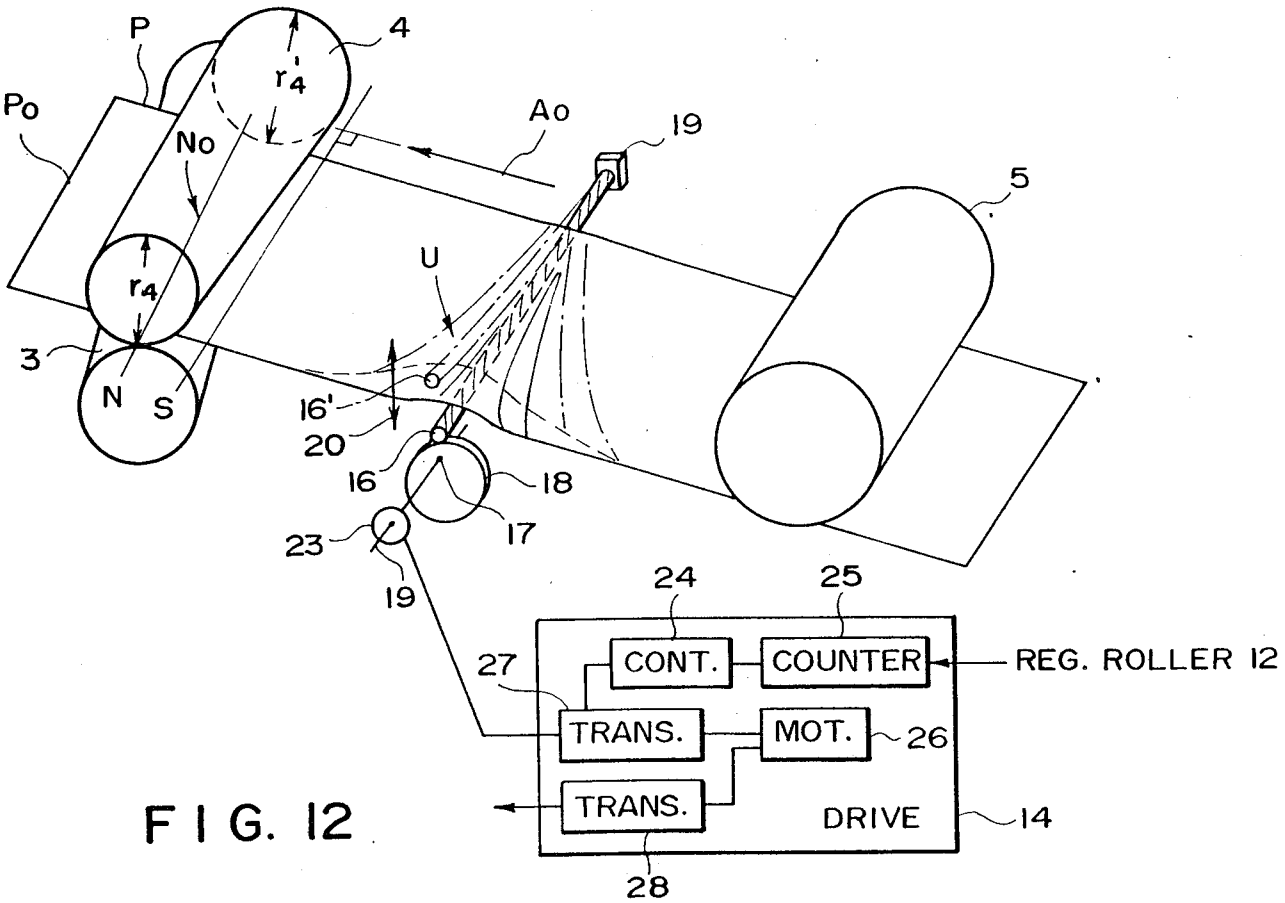
FIG. 12 is a perspective view of a major part of the image forming apparatus according to another embodiment of the present invention.
Figure 13:
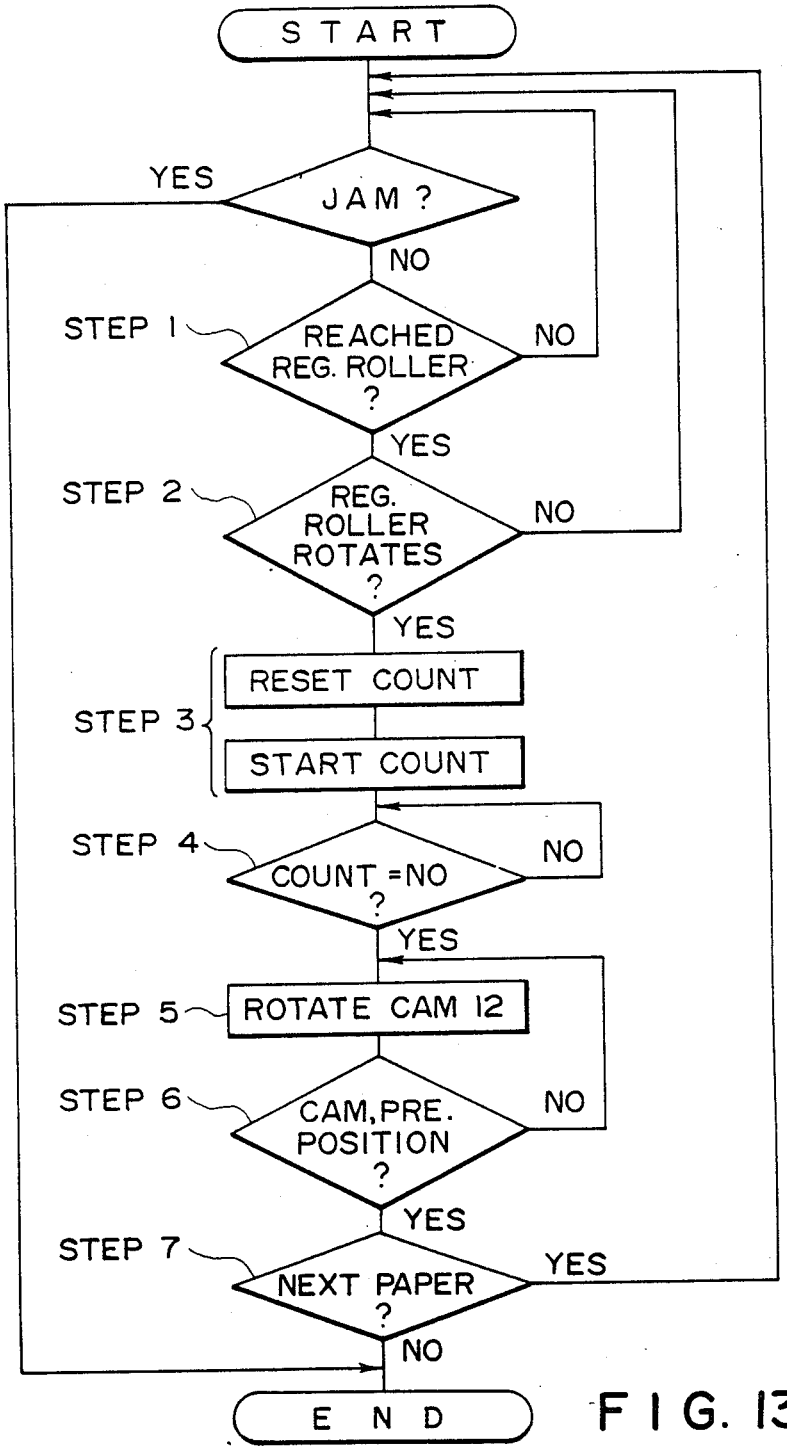
FIG. 13 is a flow chart of a control system for the apparatus shown in FIG. 12.

Referring to FIGS. 12, 13 and 3, conveying passage altering means for solving the above problem will be described.

A pivotable lever 16 is provided to constitute a part of the guiding passage 15. The lever 16 has a free end adjacent to that lateral end of the passage 15 which is near the small diameter end of the frustoconical roller 4. Adjacent to the free end, the lever 16 is contacted to an eccentric cam 18 as shown in FIG. 12. Adjacent to that lateral end of the passage 15 which is near to the large diameter side of the frustoconical roller 4, the lever 16 is pivotably coupled to a supporting member 19, about which the lever 16 is pivotable upwardly. Normally, the eccentric cam 18 maintains the position of the lever 16 so that it is flush with the surface of the guiding plate 15, thereby not impeding the passage of the sheet. The maximum cam height of the eccentric cam 18 is determined so as to provide the lift of the lever 16 corresponding to the maximum height h of the sheet curl. The maximum height is predetermined on the basis of the speed of the sheet movement and the diameters of the rollers 3 and 4. The eccentric cam 18 is rotated and controlled by control means to provide the maximum lift of the lever 16 upon the occurrence of the maximum curl. The curl of the sheet is gradually formed from the time when the leading edge Po of the sheet P reaches the nip No and assumes the maximum when the trailing edge of the sheet P comes away from the transfer station, after which the increase of the curl does not affect the image transfer. During the decrease of the lift of the lever 16, it is preferable to gradually lower the lever 16 about its pivot. When, however, there is no sheet on the lever 16, the lever 16 may be quickly restored to the flush position shown in FIG. 12 by solid lines so as not to obstruct the passage of the sheet. In this embodiment, the eccentric cam 18 has an oval cam surface in order to prevent an abrupt increase or decrease of the lift of the lever 16 and to ensure that the lever 16 substantially follows the backside of the sheet (the side without the toner image) in contact therewith in accordance with the increase of the curl U.

To the center of rotation of the eccentric cam 18, a rotational shaft 19 is fixed which is driven by a gear 23. The control of the eccentric cam 18 is effected in accordance with the flow chart shown in FIG. 13 by the driving means 14.

The driving means 14 includes a driving motor 26 which is actuated in response to depression of a main switch or generation of a copy signal, transmission means 27 and 28 for transmitting the driving force therefrom, control means 24 for controlling the transmission means 27 transmitting the driving force to the gear 23, a counter 25 for actuating at a proper timing the registration roller 12 to feed the sheet P. The transmission means 28 transmits the driving force to the other elements.

FIG. 13 illustrates by a flow chart the control of the mechanism shown in FIG. 12. Upon the generation of a copy signal, the sheet P is fed out of the cassette 21 to the registration rollers 12. This is discriminated at step 1. Then, at step 2, the rotation of the registration rollers 12, which is the start of the sheet P toward the transfer station Mo, is discriminated. Upon detection of the rotation of the registration rollers 12, the counting operation of the counter 25 is reset and is started to count. The counter 25 counts the number over a reference count number which corresponds to the leading edge Po of the sheet P reaching the nip of the fixing rollers 3 and 4 from the start of the resistration rollers 12 rotation. When the number reaches the reference number No, it is discriminated at step 4, whereupon the transmission means 27 operates to rotate the cam 18 to lift the lever 16. At step 6, the discrimination is made as to whether or not the cam 18 restores to its home position wherein the lever 16 is flush with the surface of the guide 15 (at this time, the sheet P is not on the lever 16). Subsequently, at step 8, the discrimination is made as to whether or not the next sheet is to come so that the mechanism is usable with continuous paper.

When the above-described device of this embodiment was operated with the above-described case with which the occurrence of the curl has been explained, with the maximum height of the lift of the lever 16 being 24 mm, it has been confirmed that the paper always in contact with the backside of the sheet when the curling takes place and that the deviation of the image is remarkably reduced. More particularly, when the same conditions as shown in Table 1 were taken, the amount of deviation was reduced to less than a half thereof.

Figure 1:
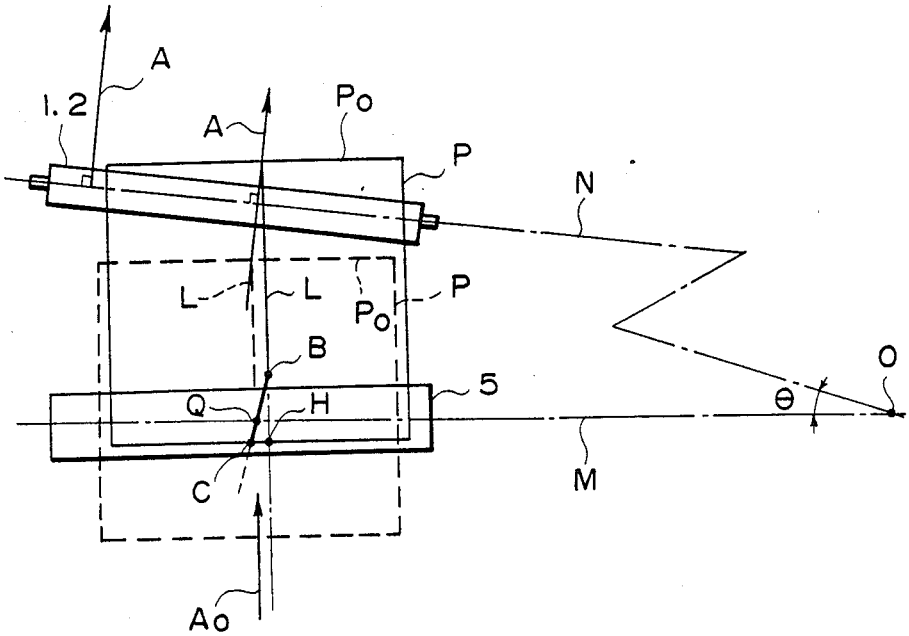
FIG. 1 is a top plan view of a copying apparatus illustrating the problem to be solved by the present invention.

In addition, when a more rigid paper (80 $g/mm^2$ or 128 $g/mm^2$) was used which might influence to the image transfer at the transfer station, the amount of the deviation was equivalent to the deviations shown in FIG. 1 according to this embodiment of the present invention.

A further embodiment of the present invention will be described, which is particularly applicable to the case where at the time when the leading edge of the recording sheet is gripped by the nip formed between the fixing rollers, the trailing edge thereof is already away from the transfer station. When the nip of the rollers is inclined by the angle $\theta$ with respect to the leading edge of the sheet as shown in FIGS. 1 and 4 in order to prevent the leading edge from entering thereto all at once, the sheet is discharged in the direction of arrow A as shown in FIG. 1. In order to correct the deviation of the sheet conveyance direction, the large diameter side of the frustoconical roller is located in the side where the leading edge of the sheet reaches the nip earlier, and the smaller diameter side of the frustoconical roller is located in the opposite side. With this arrangement, the discharging direction of the sheet is corrected. By this arrangement, the direction of the sheet conveyance can be corrected with allowing the inclined entering of the sheet leading edge to the nip.

The above-described mechanism for altering the recording sheet passage so as to follow the occurrence of the curl of the sheet between the image fixing station and the station for forming an unfixed image on the sheet, is effective to remove the force of restoring the curl, and therefore, the deviation or disturbance to the image is prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

means for forming an unfixed image on a recording material; and means for fixing the unfixed image on the recording material;

wherein said fixing means includes first and second rollers forming a nip therebetween, said first roller having a diameter which is relatively smaller at one longitudinal end thereof and is relatively larger at the opposite longitudinal end thereof, and wherein the distance between an image forming position of said image forming means and said nip formed between said first and second roller, measured along a path of the recording material, is shorter than a length of the recording material measured along the path, and wherein said first and second rollers receive a leading edge of the recording material at the nip in such a manner that the leading edge is non-parallel to the nip and said first and second rollers change a direction of movement of the recording material by the difference in peripheral speed provided by the difference in the diameter of said first roller.

2. An apparatus according to claim 1, wherein said second roller has a diameter which is relatively smaller at one longitudinal end and is relatively larger at the opposite longitudinal end, and the large diameter end of said first roller is associated with the large diameter end of the second roller, and wherein the small diameter end of said first roller is associated with the small diameter end of the second roller.

3. An apparatus according to claim 2, wherein said first and second rollers are of the same shape having a longitudinal section in the form of a trapezoid, and both of said rollers are driven by driving force.

4. An apparatus according to claim 1, further comprising means for driving said first roller.

5. An apparatus according to claim 1, wherein the diameter of the second roller is uniform along the axis thereof.

6. An apparatus according to claim 1, wherein said first roller is spool-shaped and is skewed with respect to said second roller.

7. An apparatus according to claim 1, the large diameter side of said first roller receives the leading edge of the recording material earlier than the opposite side of the first roller.

8. An image forming apparatus, comprising:

means for forming an unfixed image on a recording material;

means for fixing the image on the recording material, said fixing means including a first and second rollers for pressing and transporting the recording material therebetween, said first roller having a diameter at one end which is smaller than that at the opposite end thereof and having a longitudinal section substantially in the form of a trapezoid, wherein the distance between an image forming position of said image forming means and the nip formed between said first and second roller, measured along a path of the recording material, is shorter than a length of the recording material measured along the path, and the nip is inclinded with respect to the leading edge of the recording material being conveyed tot the nip; and wherein a portion of the inclined nip which is adapted to receive the leading edge of the recording material earlier is adjacent to a small diameter side of said first roller.

9. An apparatus according to claim 8, wherein when said first and second rollers are replaced with two phantom frustoconical rollers which have respective generating lines substantially coinciding with the nip between said first and second rollers and which provide peripheral speed difference substantially the same as the peripheral speed difference provided by said first and second rollers, an intersecting point between the generating lines of the phantom rollers and an extension of the nip is adjacent longitudinal extension of an image forming position of said image forming means.

10. An apparatus according to claim 9, wherein said intersecting point is away from the extension of the image forming station not more than 40 mm.

11. An apparatus according to claim 9, wherein said intersecting point is away from the extension of the image forming station not more than $\frac{1}{4}$ of the distance between the center of the nip and the image forming position of said image forming means.

12. An apparatus according to claim 9, wherein said intersecting point is on the extension or away from said first and second rollers beyond the extension.

13. An apparatus according to claim 8, wherein said first roller is driven.

14. An apparatus according to claim 8, wherein said second roller has a longidutinal cross-section substantially in the form of a trapezoid, and wherein the small diameter end of said first roller is disposed in association with the small diameter end of said second roller.

15. An apparatus according to claim 14, wherein when said first and second rollers are replaced with two phantom frustoconical rollers which have respective generating lines substantially coinciding with the nip between said first and second rollers and which provide peripheral speed difference substantially the same as the peripheral speed difference provided by said first and second rollers, an intersecting point between the generating lines of the phantom rollers and an extension of the nip is adjacent longitudinal extension of an image forming position of said image forming means.

16. An apparatus according to claim 15, wherein said intersecting point is away from said first and second rollers beyond the extension.

17. An apparatus according to claim 1 or 8, wherein said first and second rollers are skewed.

18. An image forming apparatus, comprising:

means for forming an unfixed image on a recording material;

means for fixing the image on the recording material, said fixing means including a first and second rollers for pressing and transporting the recording material, said first roller having a diameter at one end which is smaller than that at the opposite end;

wherein the distance between an image forming position of said image forming means and the nip formed between said first and second roller, measured along a path of the recording material, is shorter than a length of the recording material measured along the path, and the nip is inclined with respect to the leading edge of the recording material being conveyed to the nip; and wherein the nip is inclined with respect to a leading edge of the recording material approaching the nip to allow the leading edge to gradually enter the nip, and the leading edge reaches the nip at the small diameter side earlier; and means provided between said image forming means and said fixing means for altering a path of the recording material movement to accommodate a curl formed between the image forming position and the nip.

19. An apparatus according to claim 18, wherein said altering means moves up and down through a larger distance at the small diameter side of said first roller.

20. An apparatus according to claim 19, wherein said altering means includes control means for shifting a displaceable member from the time when the leading edge of the recording material reaches the nip.

21. An apparatus according to claim 18, wherein said first and second rollers are skewed.

22. An apparatus according to claim 18, wherein said second roller has a diameter which is relatively larger at one longitudinal end and is relatively smaller at the opposite longitudinal end, and wherein the large diameter side of said second roller is disposed adjacent to the large diameter side of said first roller, and the small diameter side of said second roller is disposed adjacent to the small diameter side of said first roller.

23. An apparatus according to claim 1, 8 or 18 wherein said first roller is arranged to be brought into contact with the unfixed image of the recording material.

* * * * *

UNITED STATES PATENT AND TRADEMARK OFFICE

CERTIFICATE OF CORRECTION

PATENT NO. : 4,693,587

DATED : September 15, 1987

INVENTOR(S) : MICHIO SHIGENOBU, ET AL.

It is certified that error appears in the above-identified patent and that said Letters Patent is hereby corrected as shown below:

IN THE DRAWING:

Sheet 2, Figure 3, "LIGHT INFOMATION" should read --LIGHT INFORMATION--.

ABSTRACT:

[57], line 14, "on-coming" should read --oncoming--.

COLUMN 1, line 24, "entires" should read --enters--.

COLUMN 2, line 37, "abovemade described" should read --above-described--.

COLUMN 3, line 38, "EMBODIMENTS Referring" should read --EMBODIMENTS Referring--;

line 50, "elemens" should read --elements--;

lines 53-56, close up left and right margins;

line 59, "A regis-" should read --Regis- --.

COLUMN 4, line 51, "fructoconical," should read --frustoconical,--.

UNITED STATES PATENT AND TRADEMARK OFFICE

CERTIFICATE OF CORRECTION

PATENT NO. : 4,693,587

DATED : September 15, 1987

INVENTOR(S) : MICHIO SHIGENOBU, ET AL.

It is certified that error appears in the above-identified patent and that said Letters Patent is hereby corrected as shown below:

COLUMN 4, line 64, "rollers are" should read --rollers which are--.

COLUMN 5, line 1, "analyzed" should read --analyze--;

line 38, "does" should read --do--.

COLUMN 6, line 49, "length the" should read --length of the --.

COLUMN 7, line 46, "was" (second occurrence) should read --were--.

COLUMN 9, line 3, "spoolshape)" should read --spool shape)--;

line 37, "an" should read --a--.

COLUMN 10, line 27, "when a" should read --when using a--.

COLUMN 11, line 66, "resistration" should read --registration--.

COLUMN 12, line 20, delete "to".

UNITED STATES PATENT AND TRADEMARK OFFICE

CERTIFICATE OF CORRECTION

PATENT NO. : 4,693,587

DATED : September 15, 1987

INVENTOR(S) : MICHIO SHIGENOBU, ET AL.

It is certified that error appears in the above-identified patent and that said Letters Patent is hereby corrected as shown below:

IN THE CLAIMS:

COLUMN 13, line 34, "claim 1, the" should read --claim 1, wherein the--;

line 53, "inclinded" should read --inclined--;

line 55, "tot" should read --to--.

COLUMN 14, line 17, "longidutinal" should read --longitudinal--.

COLUMN 16, line 4, "18" should read --18,--.

Signed and Sealed this

Twenty-sixth Day of January, 1988

*Attest:*

*Attesting Officer*

DONALD J. QUIGG

*Commissioner of Patents and Trademarks*